US005494261A

United States Patent [19]

Gandara

[11] Patent Number: 5,494,261

[45] Date of Patent: Feb. 27, 1996

[54] CORRUGATED PRIVACY FENCE AND METHOD OF FABRICATION THEREOF

[75] Inventor: Enrique P. Gandara, Garland, Tex.

[73] Assignee: Gandara Systems, Garland, Tex.

[21] Appl. No.: 374,832

[22] Filed: Jan. 19, 1995

[51] Int. Cl.[6] ..... E04H 17/14; E04H 17/20

[52] U.S. Cl. ..... 256/24; 256/73; 256/DIG. 5

[58] Field of Search ..... 256/24, 25, DIG. 5, 256/73; 52/770, 781, 761, 814, 456, 169.2; 160/135

[56] References Cited

U.S. PATENT DOCUMENTS

| | | | |
|---|---|---|---|
| 2,715,017 | 8/1955 | Weimer | 52/761 X |
| 3,034,610 | 5/1962 | Lynch | 256/25 X |
| 3,037,593 | 6/1962 | Webster | 256/24 X |
| 3,101,929 | 8/1963 | Dvore | 256/24 |
| 3,305,221 | 2/1967 | Kling | 256/24 X |
| 4,736,566 | 4/1988 | Krotsch | 52/814 X |

FOREIGN PATENT DOCUMENTS

| | | | |
|---|---|---|---|
| 1071246 | 4/1954 | France | 52/798.1 |
| 863271 | 3/1921 | United Kingdom | 52/781 |

OTHER PUBLICATIONS

"Attractive and Durable, Color–Coated, Galvanized Steel" by Rohn Privacy Paneling, 1992.

"Unparalled Style and Value For Commercial, Industrial and Residential Use" advertising brochure, Monumental Iron Works™, 1994.

*Primary Examiner*—Anthony Knight

*Attorney, Agent, or Firm*—Richards, Medlock & Andrews

[57] ABSTRACT

An economical metal fence includes a lateral channel frame structure and corrugated panels that fit together without requiring fasteners. The lateral channel structures firmly engage the corrugated panels for support, while the lateral channel structures are held within vertical channels with very few fasteners. The lateral channel structures and associated corrugated panels do not bottom out laterally against the vertical channels. In this manner, the spacing between fence posts is not critical.

33 Claims, 7 Drawing Sheets

FIG. 6
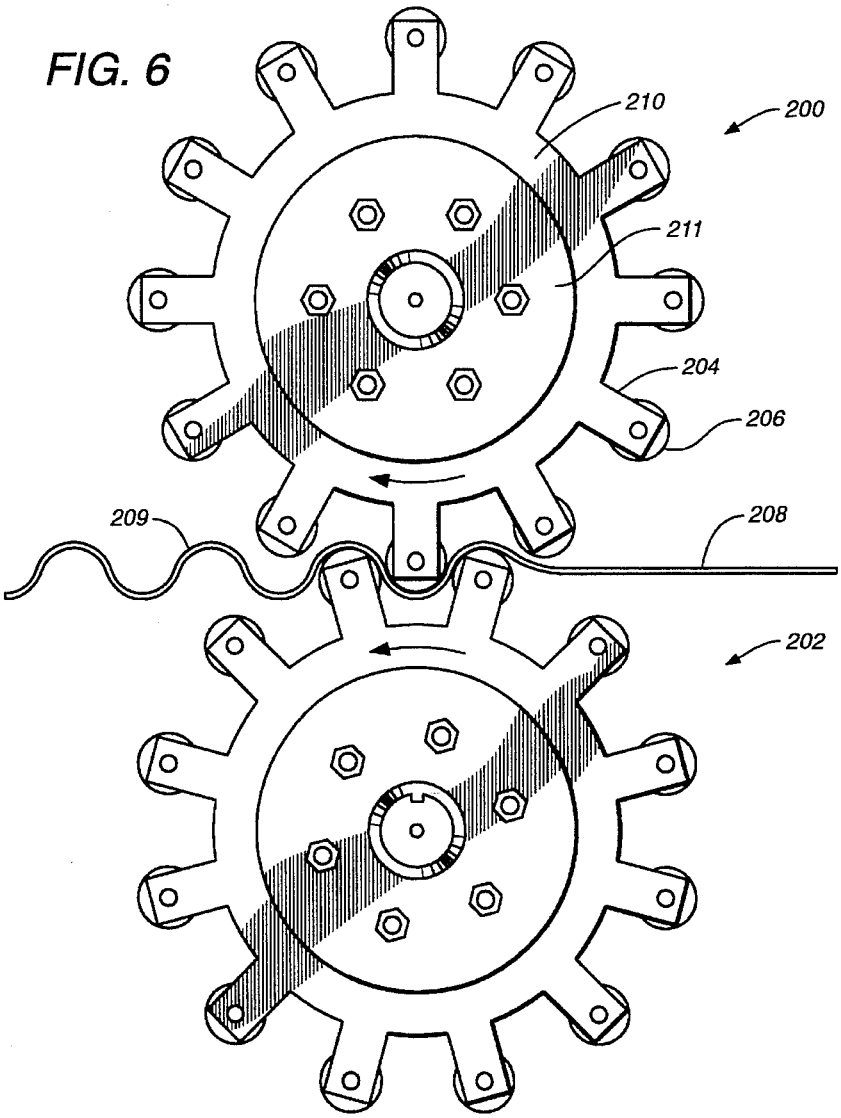
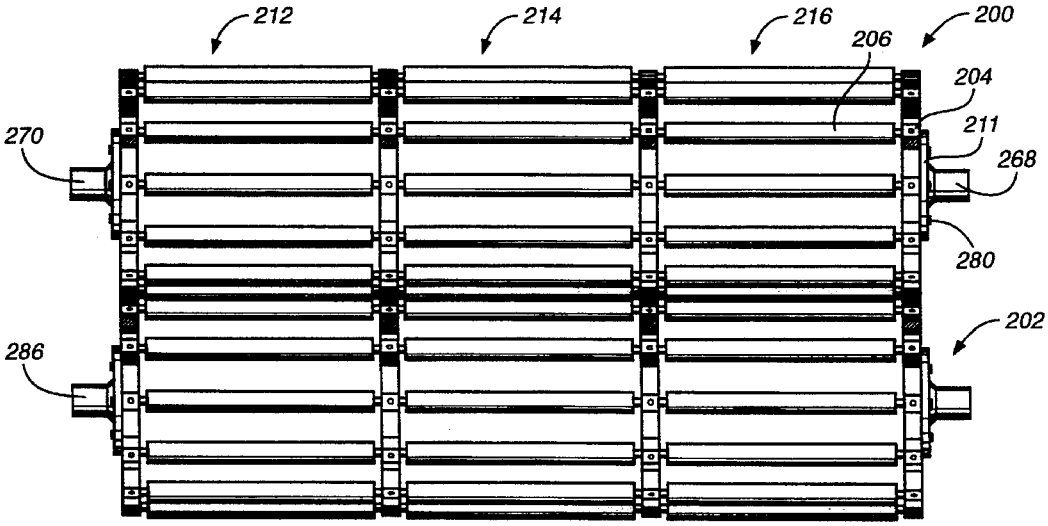
FIG. 7

CORRUGATED PRIVACY FENCE AND METHOD OF FABRICATION THEREOF

TECHNICAL FIELD OF THE INVENTION

The present invention relates in general to fences, dividers, separators, and the like, and more particularly to privacy fences and methods of fabricating and forming corrugated material for use with such fences.

BACKGROUND OF THE INVENTION

Fences have been utilized for many centuries for a host of different purposes. As a result, many different types of fences and fence structures have been employed and styled to meet specific purposes. In view of the increase in population, as well as the density of the populace, especially in suburban and metropolitan areas, fences have emerged as a necessity for safety as well as privacy.

While many fences and dividers are constructed with brick, stone and other nondestructable materials, such type of fences are very costly and are not easily or quickly constructed. On the other hand, wooden fences comprised of a number of vertical boards placed edge to edge, have experienced a great deal of popularity, due basically to the low cost, availability and the expediency by which such type of fences can be constructed. The wooden type fences range from 6–8 feet in height, and provide a substantial degree of privacy, as well as security in preventing unauthorized entry to the enclosed premises.

Wooden fences are generally constructed by anchoring either metal posts or wooden posts in the ground, via a concrete base. Then, three or more lateral wooden supports are fastened between the posts. Lastly, the vertical wooden boards or slats are quickly nailed or stapled to the lateral supports, thus completing the fence. Hinged gates and the like can be made in a similar fashion, and fastened to the vertical posts by hinges and latch mechanisms. Many different types and variations of this type of fence are available. While the vertical posts are often made of a treated wood which is highly resistant to deterioration due to moisture and insects, the lateral supports and the vertical fence boards are often made of pine or cedar, and thus last only between 5–10 years. It can be appreciated that a substantial disadvantage with wooden fences is thus the short life thereof, until some or all of the boards require replacing.

As a result of the popularity of the wood-type fences, the fabrication and the instillation of the same requires a high degree of efficiency to remain competitive. By and large, to remain competitive in installing fences, automatic nail and staple guns are utilized to expedite instillation. While eight-foot sections of wood fences can be purchased pre-assembled, the instillation time thereof is reduced, at the expense of increased cost.

In view of the foregoing, it can be seen that a need exists for an improved technique for fabricating a fence, while yet maintaining competitive with the wood fence fabricating industry. Another need exists for a technique for fabricating a privacy and/or security fence entirely of metal, at a material and labor cost that is competitive with wood fences. A further need exists for an all-metal fence structure that is aesthetically pleasing, does not degrade over time, and requires very few parts and fasteners for installation. In accordance with the foregoing, an attendant need exists for a machine that can easily and efficiently form corrugations in a precoated galvanized sheet, without scratching or otherwise marring the finish.

SUMMARY OF THE INVENTION

In accordance with the principles and concepts of the present invention, a corrugated fence structure, and method of fabrication thereof, substantially reduces or eliminates the disadvantages and shortcomings associated with the prior art wooden fences. According to the preferred embodiment of the invention, a long lasting and durable fence structure includes a channel frame structure for supporting two corrugated sheet metal panels, without requiring the use of fasteners between the corrugated panels and the channel frame structure. Installation and material cost is therefore facilitated. To install a section of fence according to the invention, spaced-apart metal posts are anchored in the ground. A left vertical channel frame portion is fastened by threaded fasteners, or the like, to the left metal post, while a right vertical channel frame portion is similarly fastened to the right post. A lower, full channel stiffener is slid down through the left and right vertical channel structures and fastened thereto by fasteners somewhat above the ground. Then, a first or lower corrugated panel is inserted between the vertical channel supports and lowered into the bottom lateral channel stiffener and is thus captured and supported on three sides thereof. A middle half channel stiffener is then slid down between the vertical supports to capture and support the top edge of the lower corrugated panel. Next, another inverted, half channel stiffener is slid down between the vertical supports to rest upon the other half channel stiffener. A second, or top corrugated panel is slid down between the vertical channel supports and captured within the channel structure. Again, the top panel is captured by the channel structures on three sides thereof. Lastly, a top full channel stiffener is inserted between the vertical channel supports to capture and support the top edge of the top panel. The top full channel stiffener is fastened by threaded fasteners to the vertical supports. In this manner, a section of fence can be quickly installed with low installation costs. The structural integrity of the fence section is not compromised, but rather provides a high degree of strength, durability and enhanced lifetime.

In accordance with another aspect of the invention, corrugated panels can be constructed with corrugations formed at an angle with respect to the top and bottom edge thereof, to accommodate ground contours or elevations. According to yet another feature of the invention, a hinged, corrugated metal gate is easily constructed, similar to that of a fence section, thereby allowing entry and exit from the fenced enclosure.

According to yet another feature of the invention, a corrugator machine is provided for corrugating precoated sheets of metal stock for the upper and lower corrugated panels. The corrugator machine according to the invention includes a top rotatable reel and a bottom rotatable reel, each with a number of roller bars that loosely interlock with each other when the reels are rotated. As the precoated metal sheet stock is passed between the reels, the roller bars deform the metal into corrugations. However, as the sheet metal passes between the roller bars and is deformed into the corrugations, the roller bars also rotate so that no sliding or relative movement exists between the roller bars and the corrugated sheet metal formed thereby. With this technique, sheet metal that is precoated on both sides thereof is not stretched, marred or otherwise scratched as it is formed into the corrugated panels as it passes between the upper and lower reels.

According to yet another feature of the invention, the upper reel can be adjusted vertically with respect to the bottom reel to form corrugations to different depths. Also, the top and bottom reels can both be pivoted about a vertical axis with respect to an in-feed table so that corrugations can be formed at an angle in the sheet metal stock.

BRIEF DESCRIPTION OF THE DRAWINGS

Further features and advantages will become apparent from the following and more particular description of the preferred and other embodiments of the invention, as illustrated in the accompanying drawings which like reference characters generally refer to the same parts, elements or functions throughout the views, and in which:

FIG. 6 illustrates the general construction of the intermeshing reels of the corrugator machine according to the invention;

FIG. 7 is a frontal view of the three ganged sections of the intermeshing corrugating reels;

DETAILED DESCRIPTION OF THE INVENTION

Figure 1:
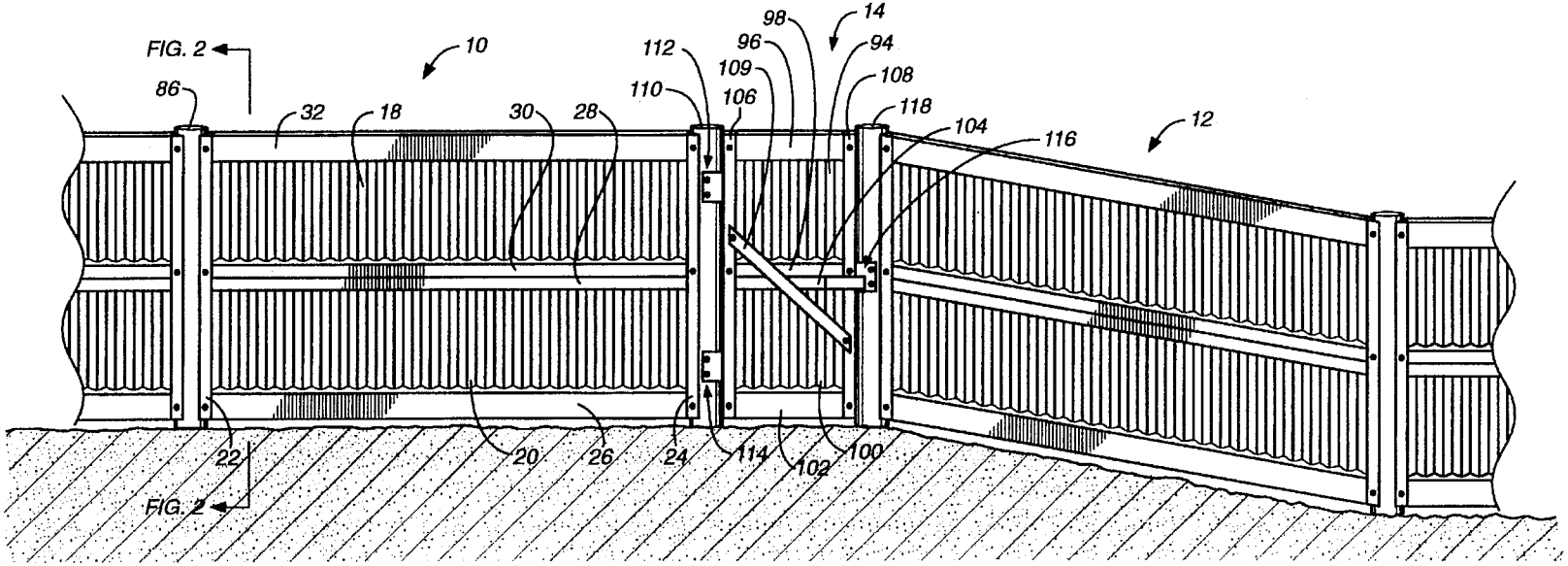
FIG. 1 is a frontal elevation view of a corrugated metal fence structure according to the invention, where a horizontal fence section is shown joined to an angled fence section by a hinged gate.

FIG. 1 illustrates a number of different components of the fence structure constructed according to the preferred embodiment of the invention. Shown is a section 10 of fence adapted for installation on generally level ground, in conjunction with a section 12 of fence adapted for installation over inclined ground surfaces, with both sections 10 and 12 coupled together by a hinged gate 14. The components of the fence structures shown in FIG. 1 are constructed entirely of a precoated galvanized sheet metal to provide a corrosion resistant fence with an extremely long life. Currently available are coils of precoated sheet metal of various colors, embossing, laminating and striping designs. An important feature of the invention not available with wood fences, is that the fence structure of the invention does not have a back side or front side for appearance purposes, but rather the front and back sides of the fence are symmetrical and thus are identical in appearance.

The fence sections 10 that are installed over generally level ground are rectangular in shape and include two corrugated panels 18 and 20, where the corrugations are formed transverse to the long, horizontal edges. The upper panel 18 and the lower panel 20 are held within a channel frame structure without the use of fasteners. The frame structure includes, in the order of installation, a left vertical channel 22, a right vertical channel 24 and a bottom full channel stiffener 26 that is secured by self-tapping screws to the bottom of the vertical channels 22 and 24. After the bottom panel 20 is installed between the vertical channels 22 and 24 and secured in the channel portion of the bottom full stiffener 26, a center half stiffener 28 is lowered in the vertical channels 22 and 24 to secure and stiffen the top corrugated edge of the bottom panel 20. Another center half stiffener is inverted (with the channel facing upwardly) and installed between the vertical channels 22 and 24 and fastened thereto with self-tapping screws. Then, the upper corrugated panel 18 is installed between the vertical channels 22 and 24 and captured at its bottom corrugated edge in the channel opening of the center half stiffener 30. Lastly, the top full stiffener 32 is installed between the vertical channels 22 and 24 to capture and constrain the top edge of the upper corrugated panel 18.

The fence section 12 is utilized for installations above ground surfaces that are inclined. The fence sections 12 are trapezoidal in shape, as shown in FIG. 1, where the opposing vertical channels remain vertically oriented, but the remainder of the fence components, e.g., the full and half stiffeners as well as the corrugated upper and lower panels, are generally inclined and parallel to the ground surface. In this manner, the fence structures of the invention can accommodate irregular ground contours to thereby follow the slope of the ground surface and provide a high degree of security as well as an aesthetically pleasing fence structure.

Figure 2:
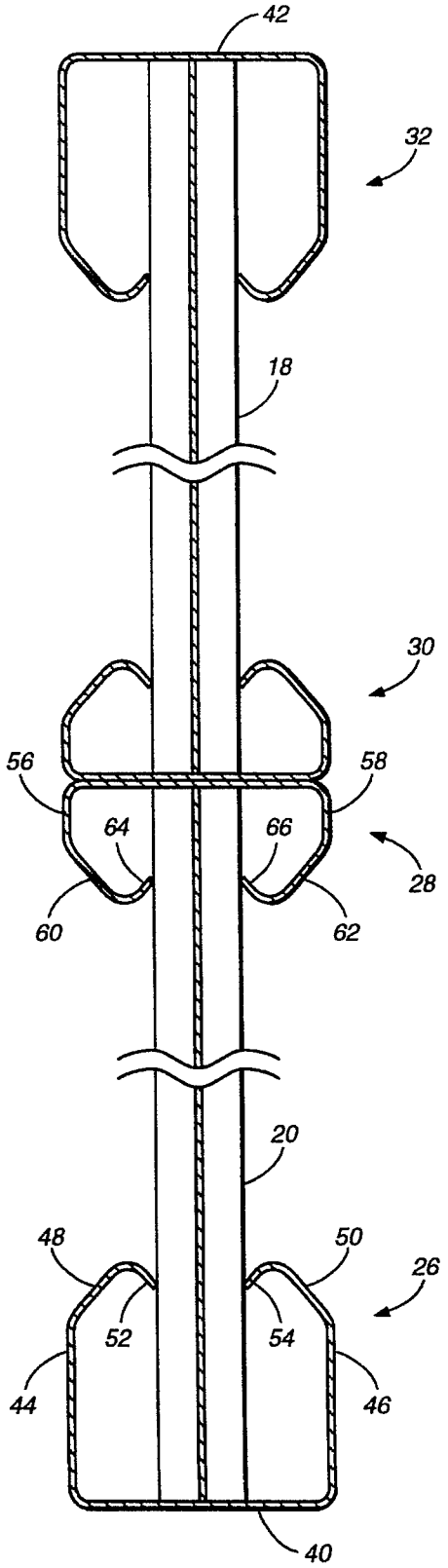
FIG. 2 is a vertical cross-sectional view of the fence, taken along line 2—2 of FIG. 1.

FIG. 2 illustrates in more detail the structural features of the fence section 10. The upper panel 18 and the lower panel 20 are constructed of a thirty gauge sheet metal, preferably of 36 or 48 inch height and 91 inch width. The panels 18 and 20 have formed therein surface irregularities, preferable vertical corrugations to provide rigidity and strength thereto. In the preferred embodiment of the invention, the corrugations are formed with curved surfaces having a valley to a peak dimension of about one inch, with about 3.5 inches between successive peaks. Of course, those skilled in the art may prefer to construct the panels 18 and 20 of different size and shapes of corrugations. Indeed, irregular shaped surfaces or corrugated panels having angled sides and flat outer surfaces may be utilized to achieve acceptable rigidity. Apparatus for forming rounded corrugations will be described in more detail below. Further, in accordance with an important feature of the invention, the upper panel 18 and the lower panel 20 are constructed identically, and thus are interchangeable. The panels 18 and 20 are preferable painted or coated with a light color.

The bottom full stiffener 26 and the top full stiffener 32 of FIG. 2 are also constructed identically, and thus are fully interchangeable. The full stiffeners 26 and 32 are preferably constructed of a 22 gauge precoated galvanized sheet, having the general shape shown in FIG. 2. The stiffeners 26 and 32 each have a respective flat surface 40 and 42 that define the top or bottom of the fence section 10, depending upon whether the full stiffener is installed at the top or bottom of the fence. The flat surfaces 40 and 42 are preferably, although not necessarily, about 2.75 inches wide. Opposing parallel sides 44 and 46 are about 2.0 inches high, and are curved inwardly with sections 48 and 50 and terminate in opposing inwardly curved edges 52 and 54. The elongate edges 52 and 54 are spaced about one inch apart to accommodate the width of the corrugated panels 18 and 20. The inside radii of each of the six internal corners of the full stiffeners 26 and 32 are formed, preferably with a 0.25 inch radius. The cross-sectional shape of each half stiffener and full stiffener is uniform throughout the length thereof.

In accordance with an important feature of the invention, the corrugated panels, such as 20, fit snugly between the edges 52 and 54 of the full stiffeners. Indeed, as the corrugated panel 20 is forcefully pushed into the channel opening of the stiffener 26, the angled members 48 and 50 are forced apart somewhat, thereby providing a slight compression fit to the corrugated panel 20. In this manner, the panel 20 does not loosely engage with the full stiffener 26 and thereby allow the panel to rattle when vibrated, such as when subjected to wind turbulence. Rather, the half and full stiffeners firmly secure the corrugated panels therein. As noted in FIG. 2, the curved edges 52 and 54 provide a tapered entrance into the channel, thus facilitating pushing the panel 20 therein by guiding the corrugated edge into the channel opening. In other words, the angled configuration of the full stiffeners, as well as the half stiffeners, provides a guiding function and a snug fit to the corrugated panels. As noted in FIG. 2, the corrugated panel 20 is inserted into the respective half and full stiffeners 28 and 26, until it bottoms out, thereby facilitating installation. The upper corrugated panel 18 similarly fits into the respective half and full stiffeners 30 and 32.

The half stiffeners 28 and 30 are constructed substantially identical to the full stiffeners 26 and 32, except the parallel side walls 56 and 58 are only about one inch high, and the sheet metal is 24 gauge. Also, the angled portions 60 and 62, together with the edges 64 and 66 compressively engage the corrugated panel 20 to provide a slightly tight fit. Again, the half stiffeners 28 and 30 are identical to each other, and thus are also interchangeable. The interchangability between the full stiffeners 26 and 32, as well as the interchangability between the half stiffeners 28 and 30 reduce the number of different components necessary to construct a fence according to the invention. The reduced number of different components also facilitates the ease with which the components can be selected and the fence constructed.

The full stiffeners 26 and 32, as well as the half stiffeners 28 and 30, are made of precoated galvanized sheet metal, preferably of a darker color as compared to the panels, to provide a pleasing contrast with the light colored corrugated panels 18 and 20. Also facilitating the aesthetic appearance of the fence 10, is the aspect that when the half stiffeners 28 and 30 are placed with the respective top and bottom flat surfaces thereof engaged together, such as shown in FIG. 2, the collective height of the two half stiffeners is about the same height as each individual full stiffener 26 and 32. Thus, from a distance, and when the stiffeners are a different color than the panels, there is a degree of symmetry. In other words, when viewed from a distance, the height of each full stiffener 26 and 32 is the same as the collective height of both half stiffeners 28 and 30 placed one on top of the other. As noted in FIG. 2, it is not necessary to fasten the corrugated panels 18 and 20 to any of the half or full stiffeners.

Figure 3:
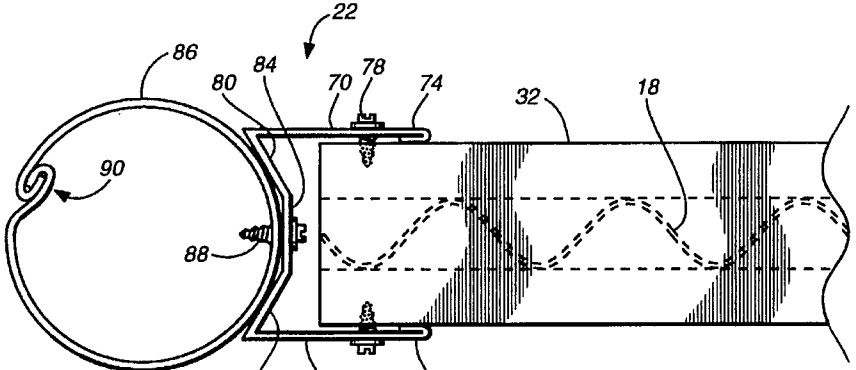
FIG. 3 is a top view of a portion of the fence structure, as it is connected via a vertical channel to a metal post.

With reference now to FIG. 3, there is depicted the manner in which the corrugated panels and stiffeners are fastened or otherwise attached to the vertical channels 22 and 24. It should be noted that while FIG. 3 illustrates the attachment of the fence components to the vertical channel 22, an identical arrangement is achieved with respect to the other vertical channel 24. The vertical channel 22 is preferably constructed of a 22 gauge precoated galvanized sheet metal in the same color as the half and full stiffeners. For fences constructed of typical 6-foot heights, the vertical channel 22 is preferably about 71 inches long. Of course, different lengths of vertical channels 22 can be constructed to achieve fences of different heights. The vertical channel 22 includes generally parallel sides 70 and 72, with a width of about 2.5 inches. Each elongated edge of the channel 22 is folded back on itself about one half inch, such as shown by reference characters 74 and 76. The folded back edges 74 and 76 eliminate sharp exposed side edges of the vertical channel 22. In accordance with another feature of the invention, the metal components of the fence have very few sharp edges, thereby reducing the possibility of inadvertent injury. The distance between the parallel sides 70 and 72 is preferably about 2 13/16 inches, while the distance between the folded back edges 74 and 76 is about 2.75 inch, the same as the width of the half and full stiffeners. The full stiffeners and the half stiffeners can be fabricated using contour roll forming machines. In like manner, the posts, the vertical channels, the gate vertical channels and stiffeners can also be formed by contour roll forming machines.

As noted in FIG. 3, the stiffeners each fit within the parallel sides 70 and 72 of the vertical channels. Each full stiffener 26 and 32 is fastened to each vertical channel 22 and 24 by a single self-tapping threaded fastener 78, on the front and back side of the fence. However, only the bottom half stiffener 30 associated with the upper panel 18 is fastened to the vertical channels 22 and 24 with a pair of fasteners 78, while the top half stiffener 28 of the bottom panel 20 does not need to be fastened to either of the vertical channels 22 and 24. This relatively few number of fasteners does not compromise the integrity or rigidity of the fence 10, but reduces the time required for assembly and installation thereof. The number of fasteners required on one side of the fence section 10 is shown in FIG. 1, it being realized that an equal number of self-tapping fasteners are utilized at the same respective locations on the other side of the fence 10.

It is noted in FIG. 3 that neither of the full stiffeners 26 or 32, or the half stiffeners 28 or 30, are fully abutted against the inside flat surface 84 of the vertical channels 22 and 24. This allows a fence section 10 of a specified width to be installed between fence posts that may vary by a few inches in the distance by which the posts are spaced apart. With this construction, the full and half stiffeners remain captured between the parallel side walls 70 and 72 of the vertical channels 22 and 24, even if the posts are spaced apart several inches more than they should be. This flexibility in the installation of the fence of the invention reduces criticality in the exact distance apart by which the posts are set into the ground. The vertical channel 22 includes angled surfaces 80 and 82 joined by a short section 84 that is generally perpendicular to the parallel sides 70 and 72. The angles between the angled portions 80 and 82 with respect to the parallel sides 70 and 72 is about 60°. As can be seen from FIG. 3, the surfaces 80, 82 and 84 accommodate a curved portion of the circular metal post 86. The surfaces 80, 82 and 84 of the vertical channels 22 and 24 could also be curved to accommodate the curvature of a metal post.

Importantly, the vertical channel 22 encompasses less than a fourth of the circumference of the metal post 86, thereby allowing for other similar vertical channels 22 to be fastened to the same post 86. A maximum of four vertical channels can be fastened to a metal post. Two self-tapping screws, such as noted by reference character 88, can be driven through the channel section 84 and into the metal post 86.

The metal post 86 is constructed of a 16 gauge precoated galvanized sheet, roll formed with an outside diameter of about 4 inches. Each vertical edge of the sheet metal of the post 86 is interlocked 90, as shown in FIG. 3. In accordance with an important feature of the invention, only a total of 16 self-tapping screws are utilized to fasten the components of the fence 10 together, as well as fasten the fence section to each metal post 86. This contrasts with the substantial number of nails or staples that are required to fasten each wooden board together to form a conventional wood fence.

As noted above, FIG. 1 illustrates a gate 14 adapted for use with the fence sections 10 constructed according to the invention. The gate 14 includes an upper corrugated panel 94 held between a full stiffener 96 and a half stiffener 98. In like manner, the gate 14 includes a lower corrugated panel 100 held between a full stiffener 102 and a half stiffener 104. Both panels 94 and 100, as well as the respective stiffeners, are situated between vertical channels 106 and 108. In this manner, the gate 14 is constructed substantially identical to the fence section 10. Additionally, the gate includes a diagonal support member 109 that is secured by fasteners between the left vertical channel 106 and the right vertical channel 108. The diagonal support 109 comprises a section of U-shaped material with edge flanges that functions to prevent the gate 14 from sagging. The gate 14 is hingeably attached to the metal post 110 by a pair of hinge-support mechanisms, such as shown by reference characters 112 and 114. A latch mechanism 116 provides an attachment between the gate 14 and the post 118.

Figure 4:
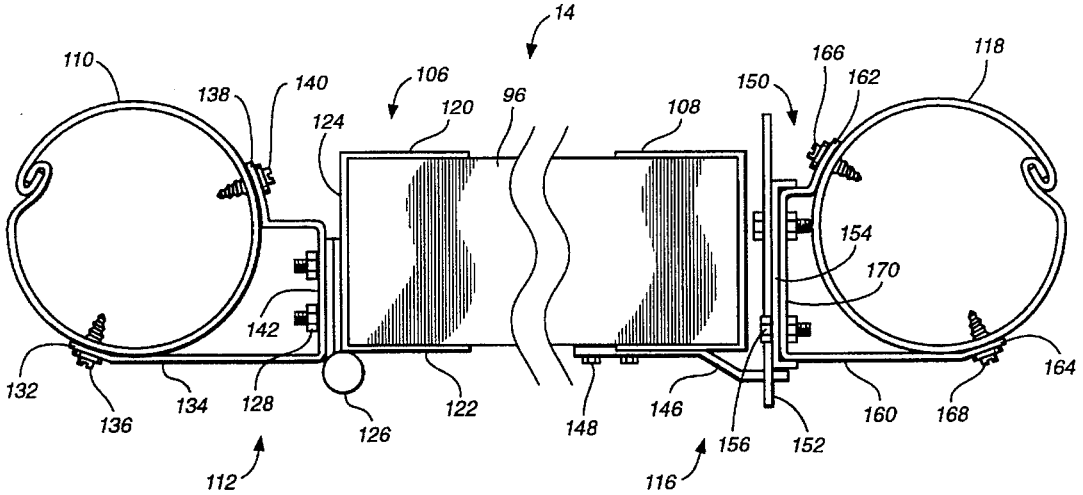
FIG. 4 illustrates a hinged connection of a gate, constructed according to the invention, to a post on one side thereof, and a latch structure on the other edge of the gate.

The hingable attachment and the security latch arrangement that supports the gate 14 between the posts 110 and 118 are shown in more detail in FIG. 4. Because the gate structure 14 does not fasten directly and rigidly to the metal post 110, the vertical upright channels 106 and 108 of the gate do not need the angled surfaces to accommodate the curvature of the post 110, as do the vertical uprights 22 and 24 of the fence section 10 as shown in FIG. 3. Rather, the vertical channels 106 and 108 can be formed of a 16 gauge precoated galvanized sheet with two opposing, parallel side members 120 and 122, and with a flat connecting member 124 formed perpendicular to the sides. In this manner, the vertical channel 106 is of simplified design requiring only two bends in the material. The other vertical upright 108 is identical, thus again providing an efficiency in manufacture as well as installation.

A conventional hinge 126 is fastened by screws (not shown) to the vertical channel 106, as well as fastened by bolts 128 to a hinge support member 112. The hinge support member 112 is formed of galvanized and painted sheet material that has a number of angle bends to firmly anchor the member 112 to the metal post 110, as well as provide a base to which the hinge 126 can be fastened. To that end, the hinge support member 112 has a short edge 132 bent somewhat inwardly with respect to a large face portion 134 to accommodate the curvature of the post 110. When a pair of self-tapping screws 136 are driven through the tab 132 and fastened into the post 110, the exposed vertical edge of the tab 132 is caused to remain flush against the outer surface of the post 110, thereby eliminating sharp edge portions of the hinge support member 112. The other edge of the hinge support member 112 includes a similar tab 138 that is also angled inwardly somewhat so that when a pair of self-tapping screws 140 are driven therethrough, the other exposed vertical edge of the hinge support member 112 remains flush against the outer surface of the post 110. The hinge support member 112 includes a flat base portion 142 that is spaced away from the post 110 a short distance to allow one plate of the hinge 126 to be fastened thereto by the bolts 128. The vertical height of the hinge support member 112 is about 4 inches, thereby providing a substantial area for fastening to the post 110 as well as for hingeably connecting the vertical channel 106 of the gate 14 thereto. In practice, it has been found that a pair of hinge support members 112 and a pair of corresponding hinges 126 are sufficient to fasten the gate 14 to a post 110, such as shown in FIG. 1.

A single latch mechanism 116 is utilized to securely latch the gate 14 to a metal post 118, such as shown in FIG. 4. The latch mechanism 116 includes a conventional latch that includes a tubular member 146 that is bolted or otherwise secured to one of the half stiffeners 98 or 104 by bolts, such as shown by reference character 148. As noted in FIG. 4, the end of the tubular member 146 protrudes beyond the edge of the vertical channel 108. A conventional gate catch mechanism 150 is utilized in cooperation with the tubular member 146 to latch the gate 14 securely and immovably to the post 118. The catch mechanism 150 includes a catch finger 152 with a hook (not shown) for engaging the end of the tubular member 146, thereby latching the parts together. The conventional catch mechanism 150 includes a base 154 to which the pivotal catch finger 152 can be secured by way of a padlock. Further, the catch base 154 is bolted with bolts 156 to the latch support member 160. The latch support member 160 has edge tabs 162 and 164 that are inwardly bent similar to the hinge support member 112 so that when self-tapping screws 166 and 168 are driven therethrough and into the metal post 118, the latch support member 160 is securely fixed thereto. The latch support member 160 includes a flat surface area 170 to which the catch base 154 is fastened, as noted above. Only a single latch support member 160 is required in conjunction with the catch mechanism 150, such as shown in FIG. 1, to latch the gate 14 to the metal post 118. The hinge support member 130 and the latch support member 160 are preferably constructed of a 16 gauge galvanized metal to provide a corrosion resistant and rigid structure for supporting the gate 14 between the posts 110 and 118. The hinge support member 112 and the latch support member 116 are preferably coated or painted the same color as the vertical channels 106 and 108, as well as the half and full stiffeners, e.g., a dark color. Of course, any color can be utilized to provide an aesthetic and coordinated color with respect to the corrugated panels of the fence and the gate.

The vertical channels 106 and 108 utilized as the gate supports can also be employed as a vertical support for a fence section 10, when the end of the section abuts against a flat surface, such as a wall. It can be appreciated that many fences terminate against the side of a house or building. The flat edge surface 124 of the fence channel 106 is well adapted for fastening to a flat surface with screws or the like.

Figure 5:
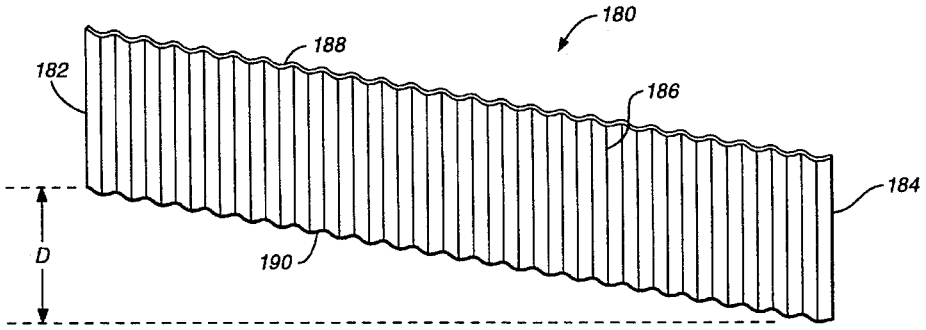
FIG. 5 is a frontal view of a corrugated panel of the type utilized with fence sections that are situated on inclined ground surfaces.

FIG. 5 illustrates a corrugated panel 180 adapted for use with fence sections 12 that are installed over inclined ground surfaces. The panel 180 is trapezoid in shape, with vertical side edges 182 and 184, as well as vertical corrugations 186. However, the top edge 188 and the bottom edge 190 are not perpendicular with respect to the side edges 182 and 184, but rather are angled to match the general angle of incline of the ground. Two such corrugated panels 180 are utilized in conjunction with half and full stiffeners, and vertical channels as described above, to construct the fence section 12. A number of different trapezoidal-shaped panels 180 can be constructed to match various angles of ground incline. With eight foot wide corrugated panels 180, standard trapezoidal shapes can be achieved by making the distance D in FIG. 5, for example, 5 inches, 10 inches, 15 inches and 20 inches, etc. The technique for fabricating the trapezoidal-shaped panels 180 will be described in detail below. Gate structures can be constructed in a manner similar to the inclined fence sections 12 to accommodate inclined ground surfaces.

Referring now to FIGS. 6 and 7, the general principles and concepts of the corrugating machine of the invention are illustrated. A pair of rotatable spoked reels 200 and 202 rotate in an interlocking manner to form corrugations in precoated galvanized sheet metal that is passed between the reels. FIG. 7 shows generally a frontal view of the two intermeshing reels 200 and 202. According to the preferred embodiment of the invention each reel includes a number of spokes 204 that support roller bars 206. The roller bars of reel 200 loosely mesh with the roller bars of reel 202, much like a pair of toothed gears. When sheet metal stock, such as shown by numeral 208, is fed between the spoked reels 200 and 202, the roller bars 206 of both reels deform the sheet metal to form corrugations 209 therein. Importantly, the sheet metal is not squeezed between alternate roller bars 206, but rather the sheet metal is simply bent without stretching. Stated another way, the closest distance between intermeshing roller bars 206 is greater than the thickness of the sheet being processed.

In accordance with an important feature of the invention, the roller bars 206 rotate as the sheet metal 208 is processed through the corrugator, thereby eliminating any sliding contact, stretching or galling between the sheet metal and the roller bars. This is extremely important when the sheet metal has been previously painted or precoated, so that the coating is not marred, scratched or disturbed as the corrugations are formed. As will be set forth in more detail below, the upper spoked reel 200 is adjustable in a vertical direction with respect to the bottom spoked reel 202 to form corrugations with different dimensions between the peaks and valleys thereof.

According to the preferred form of the invention, each spoked reel 200 and 202 includes twelve spokes 204 equidistantly spaced around the wheel 210. The outer diameter from the tip of one spoke to an opposite spoke tip is about twelve inches. As can be appreciated, when the spokes 204 and thus the roller bars 206 are spaced closer together about the circumference of the reel 200, the number of corrugations per unit length is greater.

FIG. 7 shows a general frontal view of the intermeshed spoked reels 200 and 202. Each spoked reel, such as reel 200, includes sections 212, 214 and 216 ganged together to increase the width of the corrugator and thereby permit wide sheet metal stock to be corrugated. Reel sections 212 and 216 are about 24 inches wide, while the center reel section 214 is about 28 inches wide. Of course, different numbers of sections and widths of sections can be utilized to corrugate sheet metal of different widths. The spoked reel 202 is constructed substantially identical to the spoked reel 200, and thus the details of the spoked reel 200 will be described in more detail with conjunction with FIG. 8, which illustrates the spoked reel 200 with the parts thereof removed from each other for clarity of understanding.

Each of the four spoked wheels 210 are identical, and are fabricated of steel. Each spoke 204 has a lateral bore 220 for accommodating an axle rod 222 to thus support the roller bar 206. A threaded bore is formed radially in the end of spoke 204 for inserting therein a set screw 224 which engages a flat surface 226 on the axle rod 222. With this arrangement, the axle rod 222 is fixed with respect to the spoked wheel 210. The length of the axle rod 222 is sufficient to pass through the tubular member 244 of the first reel section 212, through the adjacent spoked wheel 228 and into the end of the tubular member of the middle reel section 214. A second axle rod 232 is adapted for passing through the bores in the spokes of the spoked wheels 234 and 236 for supporting both ends of the tubular member of reel section 216 and one end of the tubular member of the middle reel section 214. A ball bearing 240 is press fit into the recessed end 242 of a tubular member 244 of the roller bar 206. Another ball bearing 246 is press fit into the opposite end of the tubular member 244. The diameter of the axle rod 222 is such that it provides a light press fit within the bearings 240 and 246.

Figure 8:
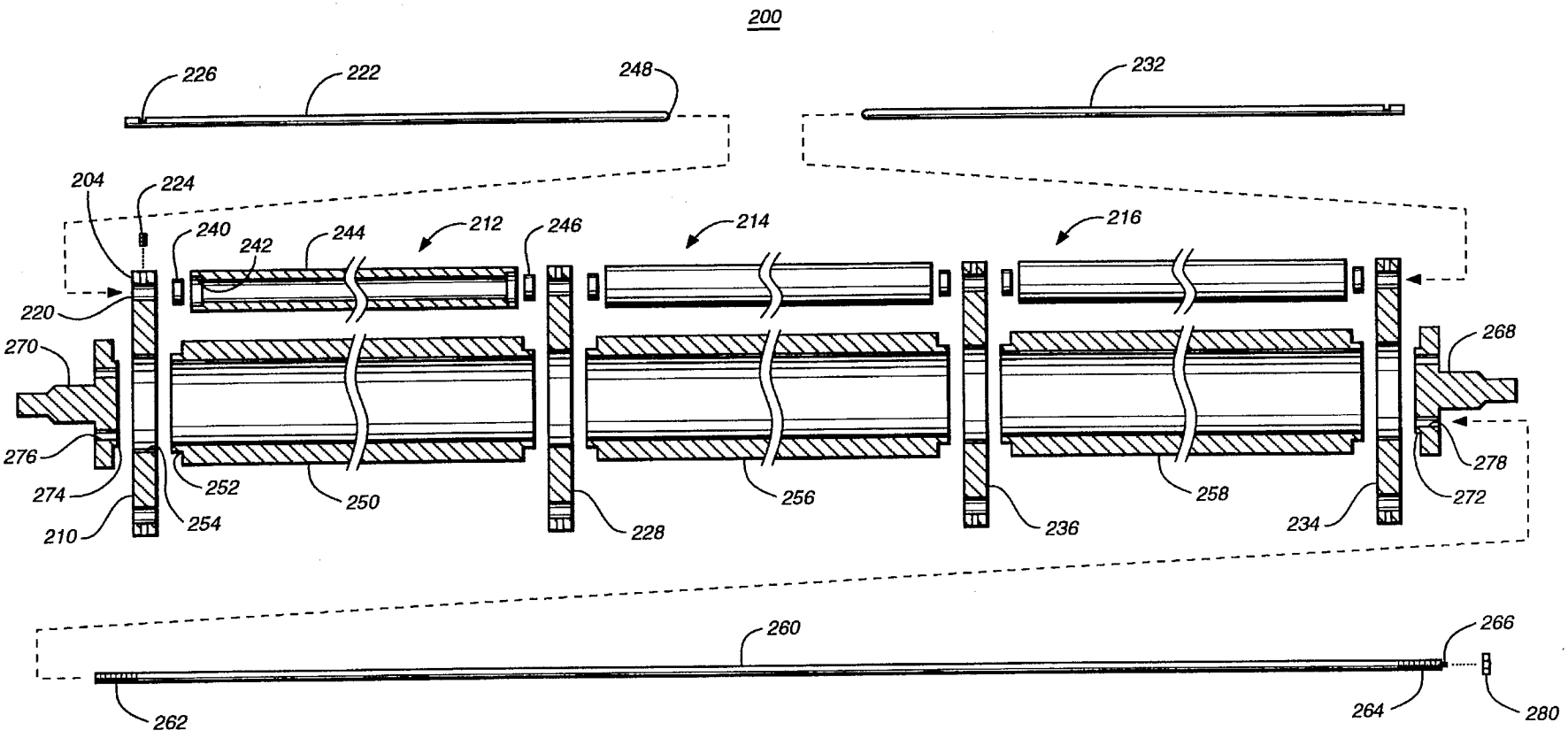
FIG. 8 is an exploded view illustrating the component parts of a corrugating reel.

As can be seen in FIG. 8, the axle rod 222 has a tapered or rounded end 248 for ease in centering within the bearings 240 and 246, as well as passing through the bore of spoked wheel 228. The remainder of the thirty-five roller bars are rotatably mounted to the respective spoked wheels in the same manner. The tubular rollers of reel sections 212 and 216 are about 23 inches long, while the tubular rollers of the center section 214 are about 27 inches long. The outside diameter of all the roller bars is about 15/16 inch. Each of the tubular rollers is constructed of a steel tubular material.

Each spoked wheel, such as 210 and 228 are maintained in a spaced-apart relationship by a cylindrical spacer 250. The cylinder spacer 250 has an annular shoulder 252 that snugly fits partially within the central opening 254 of the spoked wheel 210. The other end of the cylinder spacer 250 is constructed in the same manner to snugly fit partially within the spoked wheel 228. The other two cylinder spacers 256 and 258 engage the respective spoked wheels in the same manner. Each of the cylinder spacers is about 7.5 inches in diameter. The outer cylinder spacers 250 and 258 are about 24 inches long, while the center cylinder spacer 256 is about 28 inches long.

The components of the spoked reel 200 are clamped together by the utilization of six rods 260 that have threads 262 and 264 at respective ends thereof. The rod 260 is flattened 266 at one thereof so that a wrench can be used to prevent rotation of the rod 260 when clamping the components of the three spoked reel sections together. The opposing ends of the spoked reel 200 are capped by a first bearing hub 268 and an opposing bearing hub 270. Each bearing hub 268 and 270 has a reduced diameter portion 272 and 274 that snugly fits partially within the center bores of the outer spoked wheels 234 and 210. The bearing hub 270 has six threaded holes 276, while the bearing hub 268 has six drilled bores therethrough, as shown in FIG. 8. The threaded end 262 of the rod 260 can be screwed into the threaded holes 276 of the bearing hub 270. On the other hand, the holes 278 of the bearing hub 268 are larger than the threaded ends 262 and 264 of the rod 260. The components of each spoked reel section are clamped together by passing the threaded end 262 of the rod 260 through one of the holes 278 of the bearing hub 268, passed through the cylinder spacers 258, 256 and 250, and threaded into one of the threaded holes 276 of the bearing hub 270. After all six rods 260 are similarly installed, a nut 280 is screwed on the threaded end 264 of each rod 260. A wrench can by utilized on the flat surfaces 266 to maintain the rod 260 stationary while another wrench tightens the nut 280 to tightly clamp the reel section components together. Before the reel sections are tightly clamped together using the rods 260 and nuts 280, one roller bar in each reel section 212, 214 and 216 is installed and all three roller bars are aligned axially with a jig. Then, the nuts 280 are tightened to the respective six rods 260. The remaining thirty-three roller bars are then installed.

The round shaft portions of the bearing hubs 268 and 270 are supported by bearings for allowing rotation of the sprocket reel 200. The bearing hub of the bottom reel 202 has a machined key slot for mounting thereto a drive wheel. The bottom spoked reel 202 is driven by a motor and gear reduction so that the roller bars intermesh as shown in FIG. 6. The top reel 200 is not driven via the hub shafts, but rather is rotated by way of the intermeshing roller bars with the driven bottom reel 202. Because the roller bars 206 are rotatably mounted to the reels, very little friction exists during the corrugating process. As a result, very little power is required to drive the sprocket reels 200 and 202.

Figure 9:
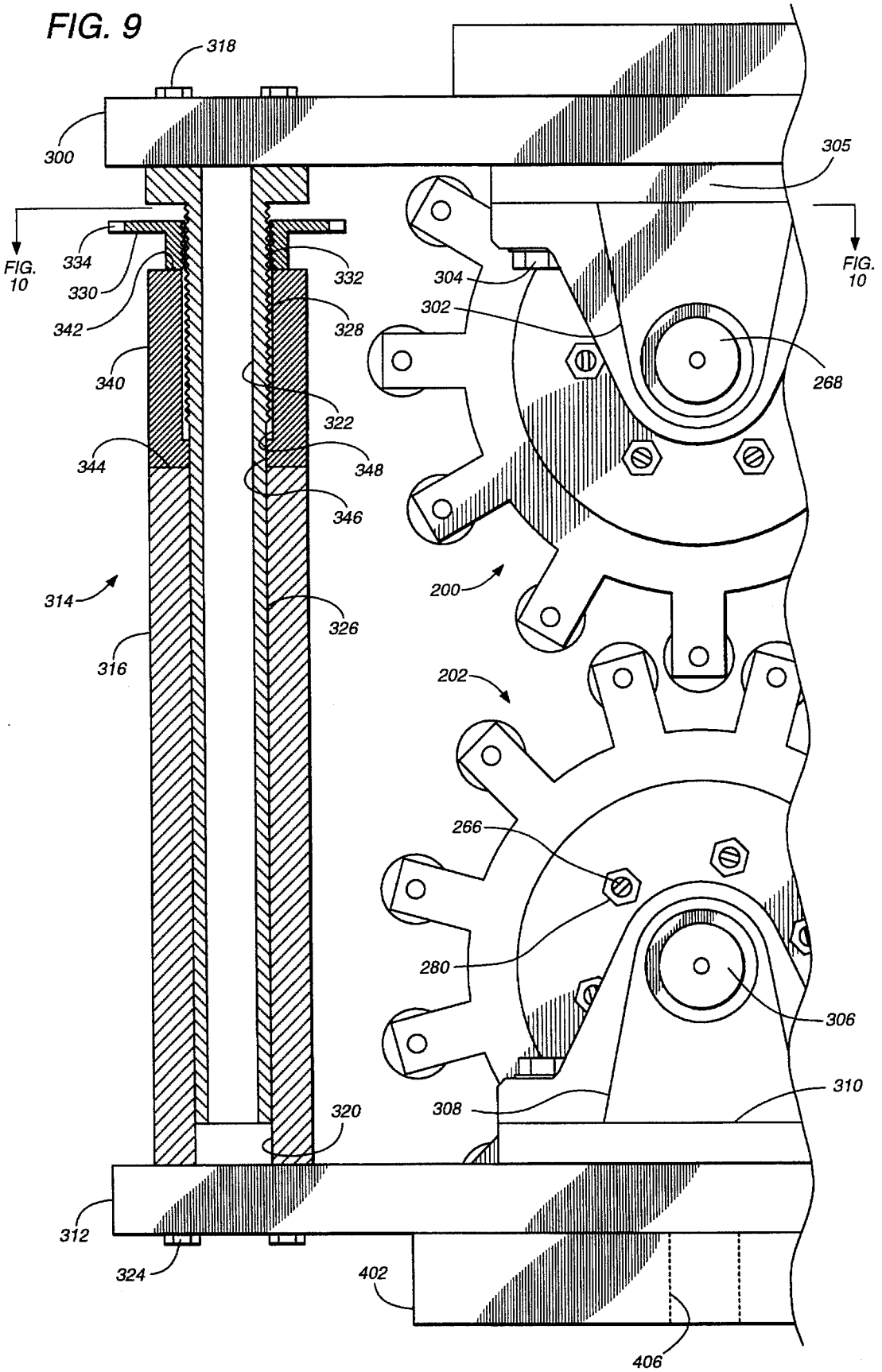
FIG. 9 is a partial sectional view of the frame and vertical adjustment support for vertically spacing the top reel with respect to the bottom reel.

The spoked reels 200 and 202 are supported in a vertically spaced apart manner with the structure shown in FIG. 9. The top spoked reel 200 is fixed to a top support plate 300 by a pillow bearing 302. The shaft 268 of the bearing hub is rotatably supported by the bearing 302. The bearing 302 is fixed to the top support plate 300 by bolts 304 and a spacer plate 305. The bolt 304 can be fastened to the top support plate 300 by a threaded hole (not shown) in the support plate 300. A hub shaft 306 of the bottom spoked reel 202 is similarly rotatably mounted within a pillow bearing 308. The lower pillow bearing 308 is fastened via a spacer plate 310 to a bottom support plate 312.

The upper spoked reel 200 and the lower spoked reel 202 are supported in a vertical spaced-apart relationship by four adjustable vertical supports, one shown as reference character 314. The top support plate 300 is generally rectangular in shape and may include other I-beam supports to provide a rigid frame structure. The bottom support plate 312 is also a rectangular rigid structure much like the top frame structure. The top frame structure is maintained vertically registered above the bottom frame structure by the four vertical supports 314 at each corner thereof. The vertical support 314 includes cylindrical parts that are telescopically adjusted with respect to each other to vary the vertical distance between the top support plate 300 and the bottom support plate 312. In this manner, the extent to which the roller bars of the top reel 200 and the bottom reel 202 intermesh can be adjusted. Essentially, the vertical adjustment between the top reel 200 and the bottom reel 202 determines the peak-to-valley dimension of the corrugations.

A bottom outer cylinder 316 is bolted or otherwise fastened to the bottom support plate 312 by bolts 324. The outer cylinder 316 has a smooth internal bore 320. An inner cylinder 322 is fastened to the top support plate 300, again by suitable bolts 318. The inner cylinder has a smooth outside surface 326 that is telescopic within the bore 320 of the outer cylinder 316. A top portion of the inner cylinder 322 is externally threaded 328 for about four inches, thereby allowing vertical adjustments between the top support plate 300 and the bottom support plate 312. A sprocket wheel 330 has internal threads 332 that threadably mate with the external threads 328 of the inner cylinder 322. The sprocket wheel 330 includes peripheral teeth 334 for engagement with a chain (not shown) so that when the chain is moved, the sprocket wheel 330 turns and provides a vertical adjustment of the top inner cylinder 322 with respect to the bottom outer cylinder 316. A collar 340 is interposed between a bottom shoulder 342 of the sprocket wheel 330 and a top shoulder 344 of the bottom outer cylinder 316. The collar 340 has a portion 346 that fits snugly around the smooth outer surface 326 of the inner cylinder 322. The collar 340 further includes a recessed portion 348 that is not threaded and freely passes over the external threads 328 of the inner cylinder 322.

In operation, it can be seen that as the sprocket wheel 330 is rotated to move upwardly on the inner cylinder 322, the weight of the top support plate 300 and attached apparatus pushes the collar 340 downwardly against the top shoulder 344 of the outer cylinder 316. The outer cylinder 316 is thereby telescopically contracted with respect to the inner cylinder 322. The top reel 200 is thereby moved downwardly toward the bottom reel 202. Opposite rotation of the sprocket 330 moves the top reel 200 upwardly away from the bottom reel 202.

Figure 10:
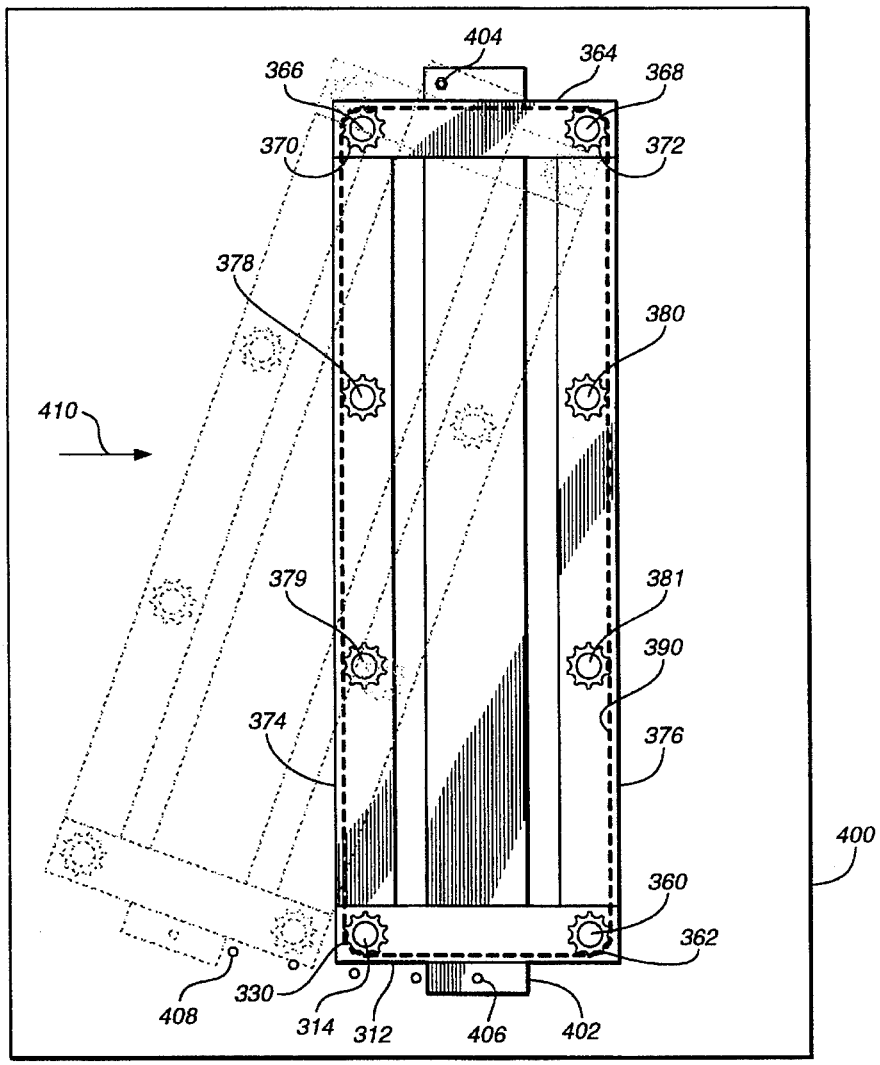
FIG. 10 is a top sectional view showing the chain-driven mechanism for vertically adjusting the distance between the top reel and the bottom reel.

FIG. 10 is a top view, taken along line 10 of FIG. 9, illustrating the general construction of the frame and adjustable vertical supports for uniformly adjusting the distance between the top spoked reel 200 and the bottom spoked reel 202. The spoked reels are removed from FIG. 10 to better illustrate the frame structure. The bottom support plate 312 supports the telescopic vertical support 314 and the corresponding sprocket wheel 330. The bottom support plate 312 also supports a corresponding telescopic vertical support 360 and associated sprocket wheel 362. At the other end of the rectangular frame there is similarly situated a bottom support plate 364 with telescopic vertical supports 366 and 368 and associated sprocket wheels 370 and 372. A top rectangular-shaped frame structure connected to the top support plate 300 is also similarly constructed and fastened at the four corners thereof to the outer cylinders, as shown in FIG. 9. The angle irons 374 and 376 are bolted onto this top rectangular-shaped frame structure as in FIG. 11. Midway between the corner sprocket wheels are a pair of idler sprocket wheels 378, 379 and 380, 381. The idler sprocket wheels 378, 379 and 380, 381 are fixed to the respective angle irons 374 and 376 in the manner shown in FIG. 11.

Figure 11:
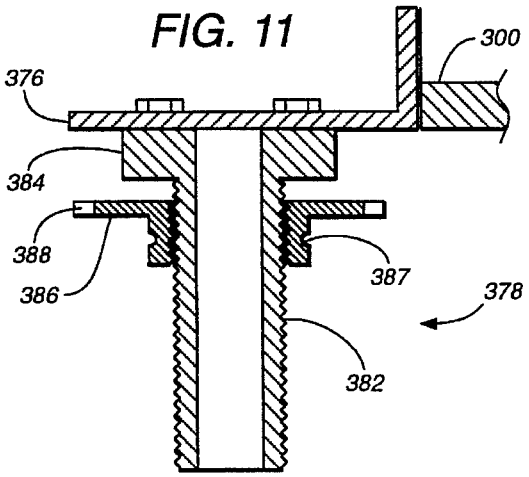
FIG. 11 is a cross-sectional view of a sprocket idler for maintaining alignment and tension on the adjustment chain.

The idler sprocket wheel 378 of FIG. 11 is constructed very much like the top cylinder 322 and the sprocket wheel 330 of FIG. 9. An externally threaded inner cylinder part 382 has a base 384 that is bolted or otherwise fixed to the angle iron support 376. An internally threaded sprocket wheel 386 with peripheral teeth 388 is threadably mounted to the inner cylinder part 382. With this construction, as a chain engages the sprocket teeth 388, and is moved, the sprocket wheel 386 advances up or down the threaded inner cylinder part 382, thereby following the up or down travel of the sprocket wheels at the four corners of the frame structure. The idler sprocket wheel 386 has a number of holes or indentions 387 formed or drilled in the base thereof for use in manually rotating the sprocket wheel 386. A spanner wrench can be utilized by engaging with the holes 387 and turning the sprocket wheel 386, thereby laterally moving chain 390 and raising or lowering the top frame structure.

A chain 390 shown in a dashed line in FIG. 10, extends around the rectangular periphery of the frame, and engages all eight sprocket wheels. Accordingly, as the chain is moved horizontally either to the left or right, all eight sprocket wheels rotate either clockwise or counter-clockwise and thereby either lower or raise the top frame structure with respect to the bottom frame structure. The chain 390 can be advanced manually with the spanner wrench, or by a cogged wheel (not shown).

It should also be understood that in the initial assembly of the corrugator machine, each of the sprocket wheels of the vertical supports at the corners are rotatably adjusted so that the top frame structure is exactly parallel to the bottom frame structure. Also, the idler sprockets 378, 379 and 380, 381 are adjusted accordingly, even though such sprockets are not effective to move the top frame structure. Then, the chain 390 is installed so as to be engaged with all eight sprockets so that when laterally moved, the entire top frame structure is moved upwardly or downwardly in unison. Further, graduation marks, similar to that on a micrometer, may be utilized in conjunction with the vertical supports 314 to visually ascertain the extent by which the top spoked reel 200 is spaced from the bottom spoked reel 202.

With reference again to FIG. 10, there is shown a flat table structure 400 on which the corrugator machine is pivotally fastened. The table 400 is of a heavy duty construction to support the corrugator machine thereon. The table 400 can be constructed with I-beam supports thereunder. The table surface itself can be a heavy duty plate steel to provide a level surface for the corrugator machine, as well as a platform for supporting elevated in-feed and out-feed surfaces for the precoated sheet stock. In accordance with an important feature of the invention, the bottom support plates 312 and 364 are welded to an enclosed I-beam frame member 402 which extends beyond the end of each bottom support plate 312 and 314. The I-beam frame 402 is welded to the bottom rectangular frame structure. Moreover, the I-beam frame 402 is fixed at a corner thereof to the table 400 by a bolt 404 or pivot shaft for allowing the corrugator machine to pivot about such point, such as shown by the broken lines. The pivot point is at the corner of the I-beam frame 402 so that irrespective of the extent by which the entire unit is pivoted, the point at which the roller bars engage the incoming sheet does not vary. Further, the I-beam frame has one or more holes 406 for fastening to the table 400 at various angular locations with corresponding table holes 408. Each table hole 408 in the table 400 can be located about an arc with respect to the pivot point 404. Each table hole 408 can be located at a desired angle so that precoated sheet metal can have corrugations formed therein at the same angle. The arrow 410 in FIG. 10 illustrates the direction in which the precoated sheet metal stock is advanced between the roller bars of the top and bottom reels. Importantly, when the corrugator machine is pivoted to form corrugations angled with respect to the side edge of the precoated sheet stock, as shown in FIG. 5, the frontal edge of the sheet stock is precut to the same angle so that the entire leading edge of the sheet enters the corrugating machine parallel to the roller bars. While not shown, one edge fence can be fastened to the in-feed table for guiding the sheet stock as it is fed to the corrugator machine. While the corrugator machine shown in FIG. 10 is manually pivoted to the desired angle, and then fastened to the table 400, those skilled in the art may prefer to automatically swivel the corrugator machine by way of pneumatic, hydraulic or electrical devices.

The components of the fence and gate, as well as the fence posts, are well adapted for fabrication by roll forming techniques using precoated galvanized sheet metal that is available in rolls.

From the foregoing, a much-improved fence structure and gate structure have been disclosed, which structures overcome the shortcomings and disadvantages of the prior art. Further, disclosed is a corrugator machine which easily and efficiently forms corrugations in sheet metal stock. The corrugating machine operates with very little power, and prevents stretching, scratching or marring of the coating on the sheet metal stock during the corrugating process. While the preferred embodiment of the invention has been disclosed with reference to a specific fence and gate structure, as well as corrugating machine, and corresponding methods, it is to be understood that many changes in detail may be made as a matter of engineering choices without departing from the spirit and scope of the invention, as defined by the appended claims.

What is claimed is:

1. A fence structure, comprising:

a rigid panel constructed of a nonorganic material, said panel being formed of an irregular-shaped surface to provide strength thereto;

a pair of fence posts;

a bottom and top stiffener for defining a channel for receiving therein a respective bottom and top edge of the panel to provide support thereto; and a pair of opposing Channel side members attachable to said fence posts, and to which the top and bottom stiffeners are fastened therein to result in a rigid fence structure, said pair of opposing channel side members having substantially parallel sidewalls of sufficient lateral length so that said top and bottom stiffeners can be inserted therein while vet having a degree of lateral movement, whereby said fence posts can be set in the ground at inexact spacings.

2. The fence structure of claim 1, wherein said rigid panel is constructed of metal having corrugations formed therein.

3. The fence structure of claim 2, wherein said top and bottom stiffeners are shaped to form flexible edges defining an opening to provide a compression fit with the corrugated panel.

4. The fence structure of claim 2, wherein said top and bottom stiffeners have entrance edges to the respective channels, and wherein the entrance edges of the respective stiffeners are spaced apart somewhat less than a peak-to-valley dimension of the corrugated panel, whereby when a corrugated edge of the corrugated panel is inserted into a respective channel between the entrance edges thereof, a snug fit therebetween is established.

5. The fence structure of claim 2, wherein the panel is trapezoid in shape with the corrugations being parallel to opposing side edges and not perpendicular to a top and bottom corrugated edge of the panel.

6. The fence structure of claim 1, wherein respective edges of said rigid panel are captured by said top and bottom stiffeners without fixing thereto by fasteners.

7. The fence structure of claim 1, wherein said rigid panel and said bottom and top stiffener define a top fence section, and further including a bottom fence section constructed substantially identically as said top fence section, and wherein said fence section is situated above the bottom fence section, with a bottom stiffener of said top section engaging a top stiffener of said bottom fence section.

8. The fence structure of claim 1, wherein said top stiffener is about twice the height as the bottom stiffener.

9. The fence structure of claim 1, wherein said top and bottom stiffeners have respective entrance edges that are angled inwardly to provide a guiding function when the panel is inserted into the stiffeners.

10. The fence structure of claim 1, further including in combination a gate constructed of substantially the same fence components as the fence.

11. The fence structure of claim 1, wherein said opposing channel side members comprise channels for receiving therein respective ends of said top and bottom stiffeners.

12. A fence structure, comprising:

a first corrugated panel;

a first set of sheet metal stiffeners roll formed into a channel structure to define respectively a top and bottom channel stiffener for receiving therein and engaging with respective top and bottom edges of said first corrugated panel;

a second corrugated panel that is distinct and separate from said first corrugated panel;

a second set of sheet metal stiffeners roll formed into a channel structure to define respectively a top and bottom stiffener for receiving therein and engaging respective top and bottom edges of said second corrugated panel; and wherein the bottom sheet metal stiffener of the first panel is substantially identical to and engages with the top sheet metal stiffener of the second panel so that the first panel and first set of sheet metal stiffeners can be situated over and rest on the second panel and the second set of sheet metal stiffeners.

13. The fence structure of claim 12, further including a pair of opposing roll formed sheet metal side members for engaging with the first and second set of sheet metal stiffeners.

14. The fence structure of claim 13, further including a pair of fence posts to which the sheet metal side members are fastened.

15. The fence structure of claim 12, wherein the first and second corrugated panels are not fastened with fasteners to the respective first and second set of sheet metal stiffeners.

16. The fence structure of claim 12, further including in combination a hinged gate constructed with substantially the same components as said fence structure.

17. A fence structure, comprising:

a top and bottom corrugated panel;

a plurality of horizontally disposed stiffeners, each stiffener defining a channel with a flexible opening for receiving therein corrugated edge of the corrugated panel, said opening of the channel including opposing yieldable edges angled inwardly toward each other to provide a compression fit with the corrugated edge of the panel, said stiffeners being engaged with a respective top or bottom edge of one said corrugated panel;

a pair or opposing vertical channels for receiving therein an end of each said stiffener; and fasteners for fastening one or more of the ends of the stiffeners to the vertical channels.

18. The fence structure of claim 17, wherein each said vertical channel has a pair of parallel sides connected by a concave surface for conforming to a curved fence post.

19. A method of fabricating a fence structure, comprising the steps of:

forming corrugations into sheet metal;

forming horizontally disposed stiffeners engageable with the corrugated edges of the corrugated sheet metal, said forming step including forming the stiffeners in a channel-like shape with flexible side members that provide a compression fit to the corrugated edges of the sheet metal, whereby the stiffeners strengthen the corrugated edges when inserted thereover and prevent slack therebetween.

20. The method of claim 19, further including forming the corrugations at a nonperpendicular angle with respect to the top and bottom corrugated edges of the sheet metal.

21. The method of claim 19, further including forming the corrugations in a precoated sheet metal without marring a precoat finish on the sheet metal.

22. The method of claim 21, further including forming the corrugations by rolling a corrugation forming tool on opposing sides of the sheet metal.

23. The method of claim 19, further including forming the stiffeners so that when the sheet metal edge is inserted therein, no fasteners are needed therebetween for maintaining the stiffeners attached to the corrugated sheet metal.

24. The method of claim 19, further including forming a vertical member for fastening the stiffeners thereto in a vertically spaced apart relationship with the corrugated sheet metal compressively fixed therebetween.

25. The method of claim 24, further including forming the vertical member in a channel shape so that an end of the respective stiffeners can be inserted into the vertical channel member.

26. The method of claim 25, further including forming the vertical channel member with opposing parallel sides connected by a surface that is concave for conforming to a curved surface of a fence post.

27. The method of claim 19, further including forming a first horizontally disposed stiffener with a predefined height, and forming a second pair of horizontally disposed stiffeners each having about one-half the height of the first stiffener so that when the pair of stiffeners are laid horizontal one on top of the other a combined height is about the same as that of the first horizontally disposed stiffener.

28. The method of claim 27, further including forming the pair of stiffeners each with a flat surface for engaging one another.

29. A fence structure fabricated according to the method of claim 19.

30. A fence section structure, comprising:

a pair of substantially identically shaped panels;

a pair of substantially identically shaped roll formed sheet metal half stiffeners, each formed with a channel for receiving therein and supporting an edge of a different said panel;

a pair of substantially identically shaped roll formed sheet metal full stiffeners, each formed with a channel for receiving therein and supporting an edge of a different said panel; and a pair of substantially identically shaped roll formed sheet metal vertical channel members for engaging respective side ends of the half and full stiffeners, whereby the fence section structure comprises only four different sheet metal components.

31. The fence section structure of claim 30, further including a pair of sheet metal posts.

32. The fence section structure of claim 30, further including only twelve fasteners to fasten the fence section together to form a rigid fence section structure.

33. The fence section structure of claim 32, wherein the twelve fasteners are used to fasten together the stiffeners to the vertical channel members.

* * * * *